US005288063A

United States Patent [19]

Lunt

[11] Patent Number: 5,288,063

[45] Date of Patent: Feb. 22, 1994

[54] MULTI-LENGTH SHEET MATERIAL CONVEYOR AND COLLATOR

[75] Inventor: Reginald F. J. Lunt, Rutland, Vt.

[73] Assignee: Metromail Corporation, Lincoln, Nebr.

[21] Appl. No.: 799,984

[22] Filed: Nov. 29, 1991

[51] Int. Cl.[5] ..... B65H 9/10; B65H 39/10

[52] U.S. Cl. ..... 270/58; 270/59

[58] Field of Search ..... 270/32, 45, 51, 52, 270/53, 54, 55, 56, 57, 58, 37, 1.1; 198/626.5, 697, 699, 719, 817

[56] References Cited

U.S. PATENT DOCUMENTS

| | | | |
|---|---|---|---|
| 2,668,614 | 2/1954 | Lawson | 198/697 X |
| 3,325,977 | 6/1967 | Kirsten | 198/817 X |
| 3,833,212 | 9/1974 | Wise | 270/58 |
| 4,125,253 | 11/1978 | Wangermann | 270/58 |
| 4,250,988 | 2/1981 | Miaskoff | 198/719 |
| 4,273,319 | 6/1981 | Stocker | 270/58 |
| 4,466,603 | 8/1984 | Schnell | 270/58 |
| 4,572,497 | 2/1986 | Dreschel | 270/58 |
| 4,641,555 | 2/1987 | Johnson | 270/58 |
| 4,677,910 | 7/1987 | Kuhfuss | 270/58 |
| 5,033,727 | 7/1991 | Szewczyk et al. | 270/54 |
| 5,120,036 | 6/1992 | Simons | 270/53 |
| 5,145,053 | 9/1992 | Krieger et al. | 198/817 X |
| 5,165,519 | 11/1992 | Pund et al. | 198/719 X |

FOREIGN PATENT DOCUMENTS

| | | | |
|---|---|---|---|
| 2456908 | 8/1976 | Fed. Rep. of Germany | 270/58 |

*Primary Examiner*—Edward K. Look
*Assistant Examiner*—John Ryznic
*Attorney, Agent, or Firm*—Jacobson, Price, Holman & Stern

[57] ABSTRACT

A multi-length sheet material conveyor and collator is provided including a first conveyor for receiving successive cut sheets from a cutter and a second conveyor for receiving cut sheets from the first conveyor and arranging the received cut sheets in collated sets of sheets. The second conveyor includes drive structure for intermittently driving the collated sets of sheets therealong and support structure whereby additional equipment may be supported from the second conveyor for performing single or multiple additional operations on the collated sets of sheet material such as stapling, gluing and token tipping.

13 Claims, 6 Drawing Sheets

MULTI-LENGTH SHEET MATERIAL CONVEYOR AND COLLATOR

BACKGROUND OF THE INVENTION

1. Field of the Invention

This invention relates to the collation and preparation of flexible (paper) sheets for use on mail preparing machines known as inserters and constitutes an improvement over that disclosed in U.S. Pat. No. 5,033,727.

2. Description of Related Art

Known inserter machines have insert storing hoppers positioned along a common conveyor. The inserts within each hopper are dispensed one at a time to the common conveyor for presentation to the insert station.

The inserts within each insert storing hopper are separated from the supply stack of inserts therein by a vacuum cup and a separator foot. Since the vacuum foot pulls downward on the bottom of the lowest sheet of material in the supply stack, the bottom sheet must be singular or, if plural, must be bound with a folded edge, stapled, glued or some other means to the sheet or sheets of material thereabove. This is necessary if the multiple sheets are to be dispensed to the conveyor as a set.

Another common means to dispense multiple pages from a supply stack is by means of aligned punched holes in a number of lower pages. A vacuum cup is positioned over the aligned holes and vacuum penetrates the holes to the first unperforated sheet. As the vacuum cup pulls downward, the perforated sheets and the unperforated sheet thereabove are pulled downward and separated from the stack.

This latter method of sheet preparation presents one obvious problem. Holes must be placed in sheets which have printing thereon, thus restricting the positioning of the printing.

The objective for the instant invention is to provide a means of taking paper which has been cut from a continuous web by a paper cutting machine and presenting the paper on an electronically controlled intermittently driven conveyor. The conveyor electronically counts incoming sheets of paper and indexes when a preset number of sheets has been cut. The conveyor has the ability to collate sheets of one length or sheets of multiple lengths. Once collated, the sheets of material may be transferred by the conveyor to an addition modular supply hopper which dispenses a cover sheet to the conveyor path. The collated sheets are transferred to a modular device which binds the sheets together with a staple or staples along a common edge. The bound collated sheets are then placed on a conveyor and manually gathered into stacks where the conveyor can be an in-line modular piece of the production line consisting of a paper cutter or other equipment such as a paper folding machine or bound edge padding machine.

SUMMARY OF THE INVENTION

In accordance with the present invention the multi-length conveyor receives a paper web from a roll of paper and cuts the paper web into selective length sheets of paper by a bowe cutter from which the individual sheets of paper are fed to a collating section. The individual sheets of paper are fed to the collating section by friction belts which move continuously and the individual sheets being collated may be of different lengths, determined by the programmed bowe cutter. The individual sheets to be collated into a set of sheets are maintained stationary as they are being collated and, after the proper number of sheets have been collated, while being disposed on tooth belts, they are advanced by the toothed belts to the inlet end of a main conveyor along which various additional equipment may be mounted for performing additional operations on the collated material such as stapling, gluing and token tipping. Electronically controlled interfaces are provided for the control of additional operations. The conveyor is portable, height adjustable and easily interfaced with other pieces of equipment.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
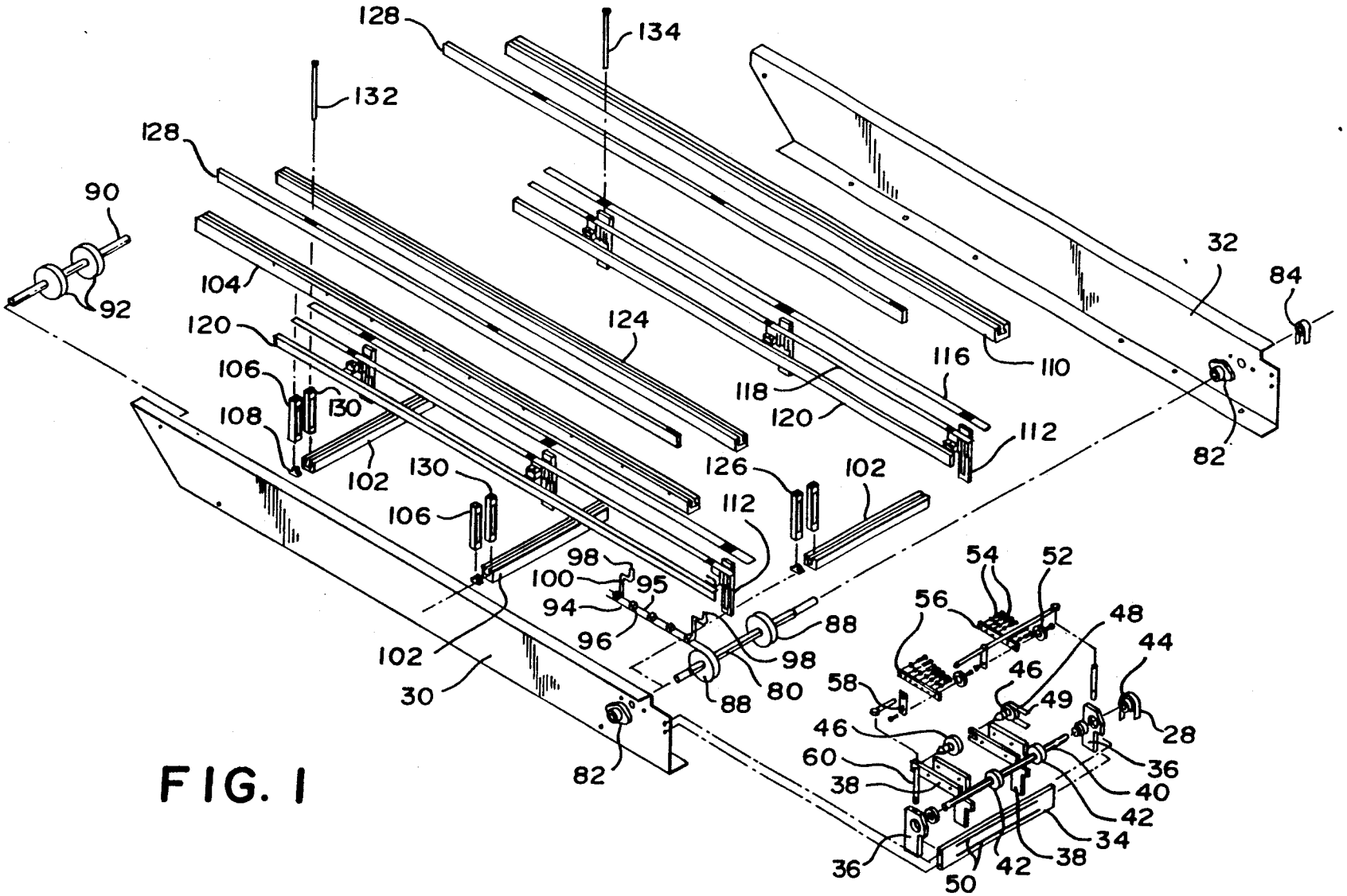
FIG. 1 is an exploded perspective view of major components of the conveyor with certain components fragmentarily illustrated and duplicated components omitted for the sake of clarity.
Figure 2:
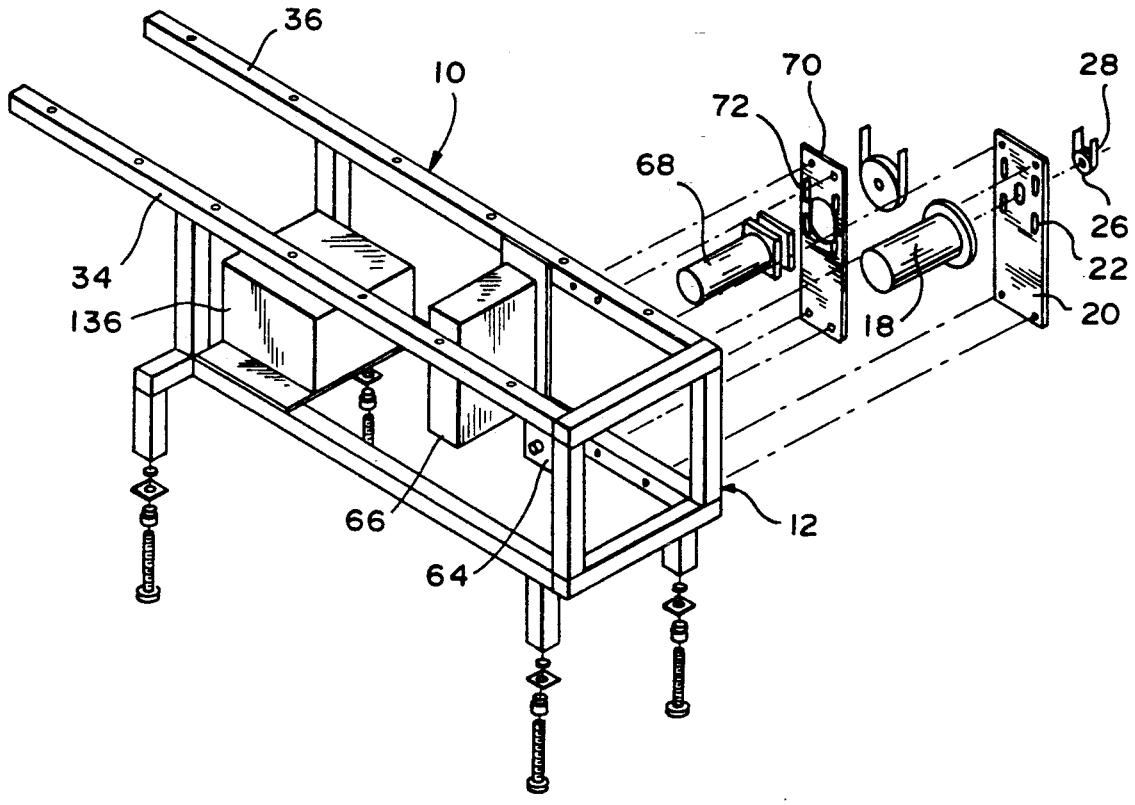
FIG. 2 is an exploded perspective view of the drive mechanism for the conveyor and the controls therefor, portions of the drive mechanism being broken away.
Figure 3:
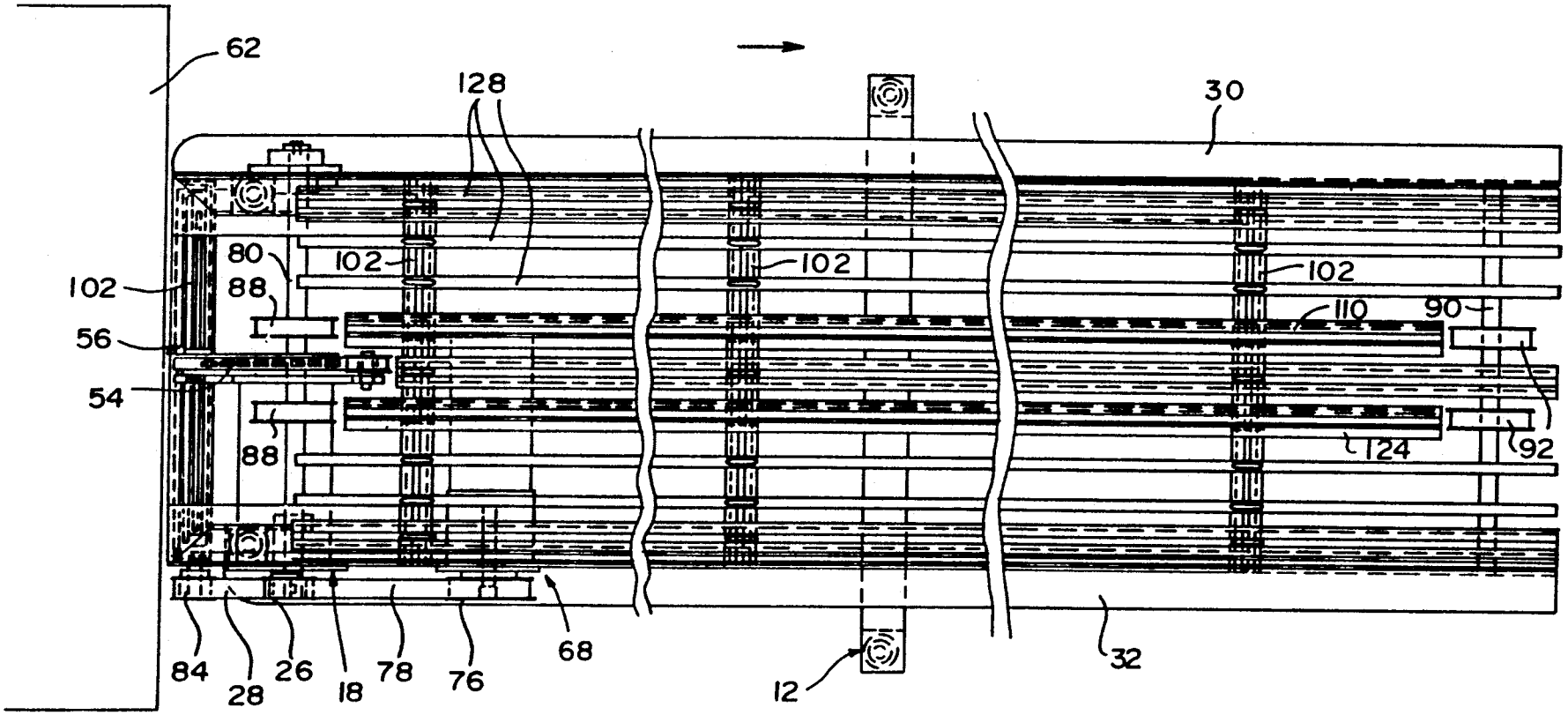
FIG. 3 is a fragmentary top plan view of the conveyor with the conveyor belts thereof omitted for clarity.
Figure 4:
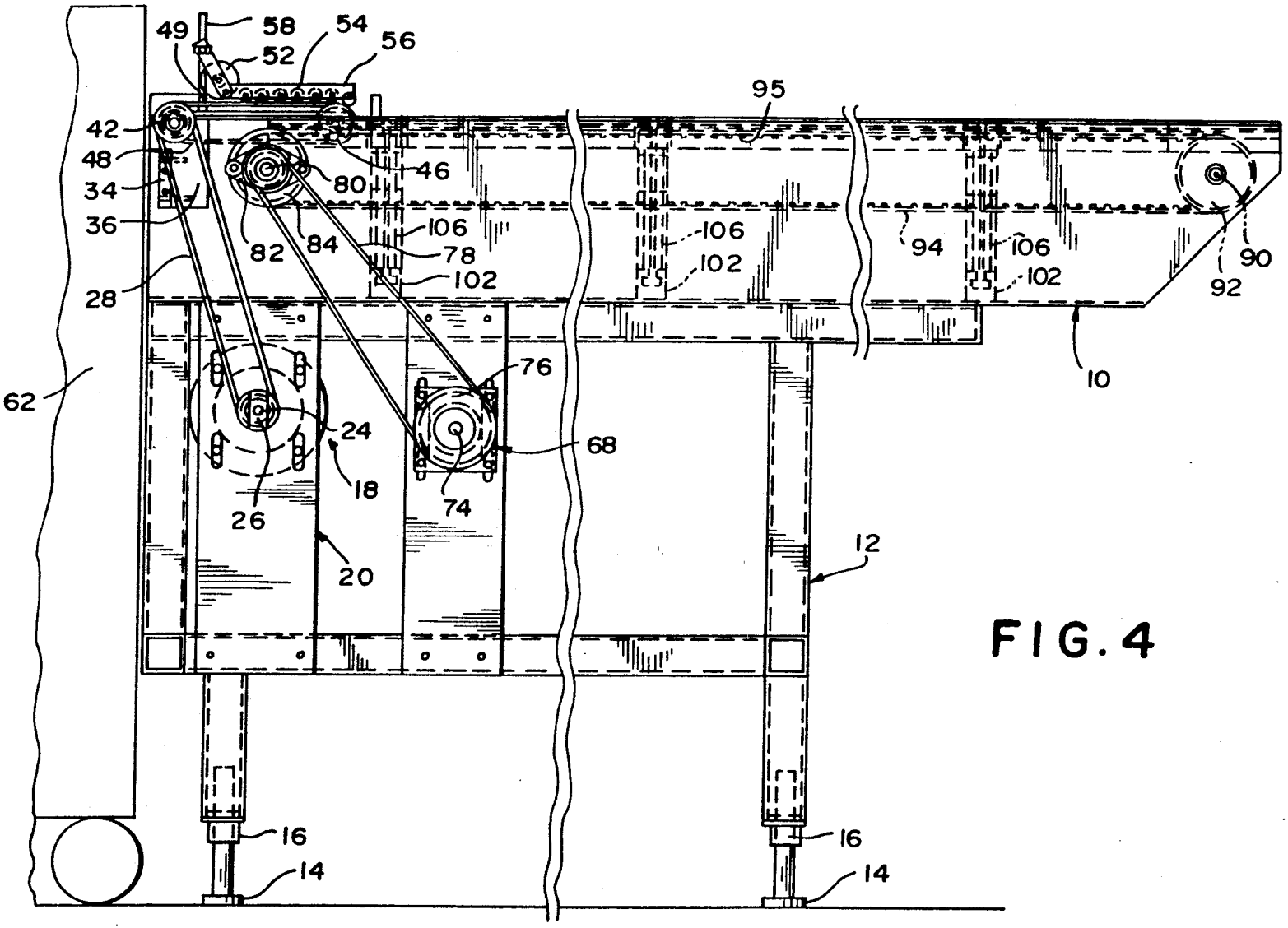
FIG. 4 is a fragmentary side elevational view of the conveyor.
Figure 5:
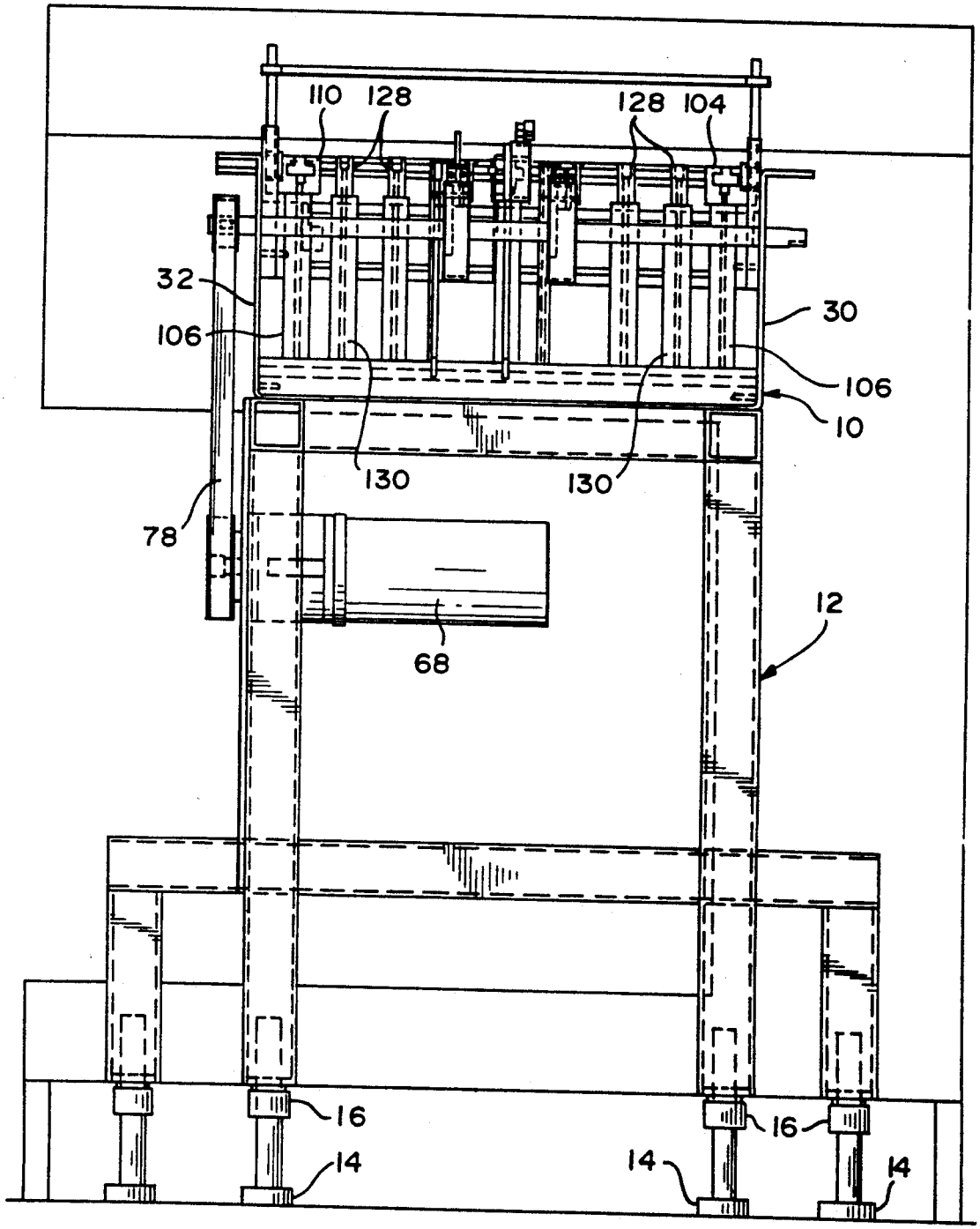
FIG. 5 is an enlarged end view of the conveyor as seen from the right side of FIG. 3.
Figure 6:
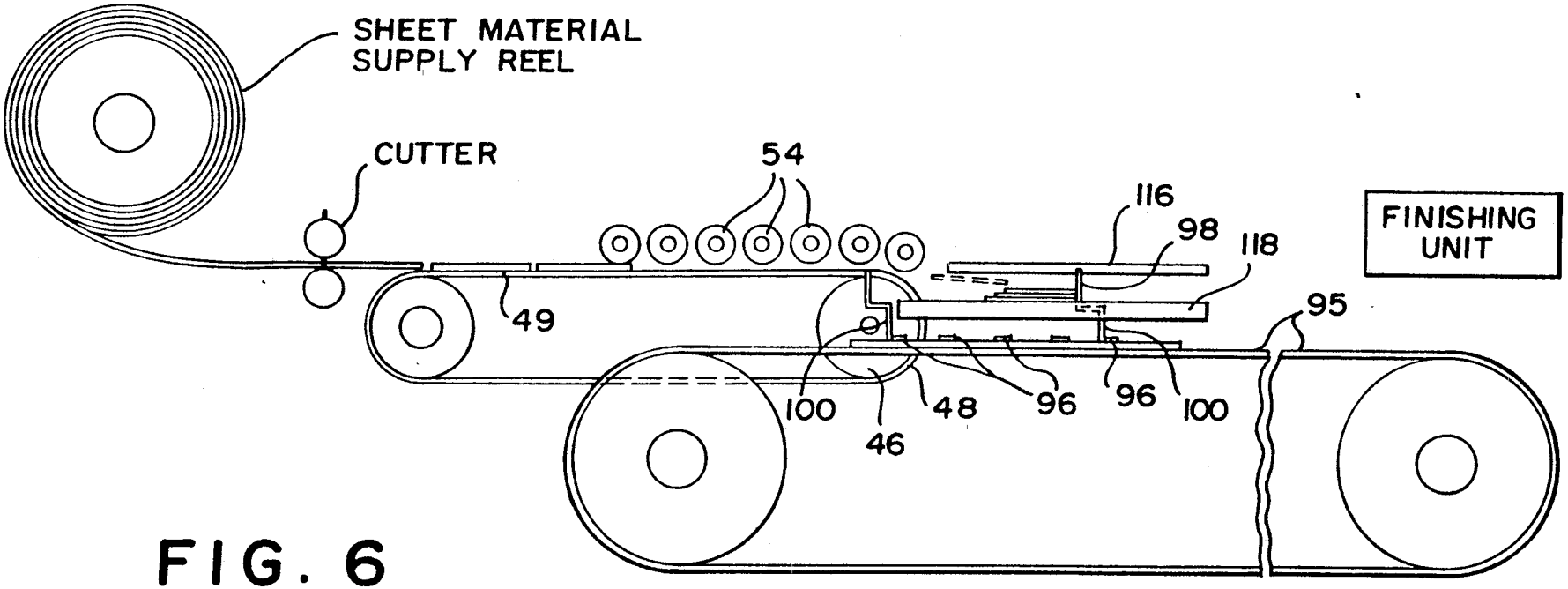
FIG. 6 is a fragmentary schematic view illustrating the manner in which cut sheets are discharged from the first conveyor onto a pair of laterally spaced material supports upwardly between which combined stop and pusher links supported from a second intermittently actuable conveyor project.

Referring now more specifically to the drawings and to FIGS. 2 and 4 in particular, the reference numeral 10 generally designates the multi-length conveyor including a support frame 12 at its inlet end having threaded adjustable feet 14 which may be secured in adjusted position through the utilization of threaded nuts 16. The frame 12 mounts an end feed conveyor drive motor 18 thereon through the utilization of a mounting plate 20 having vertical mounting slots 22 therein by which the height of the motor 18 may be adjusted and the motor 18 includes a rotary output shaft 24 upon which a drive pulley 26 is mounted, the lower end of a drive belt 28 being trained about the pulley 26.

A pair of side plates 30 and 32 are mounted from the upper longitudinal members 34 and 36 of the frame 12 and extend the full length of the conveyor 10.

A mount bar 34 is mounted across the inlet end of the conveyor 10 from and between the side plates 30 and 32 through the utilization of a pair of mounting plates 36 and second pair of mounting plates 38 ar mounted from the bar 30 in adjusted position therealong and with adjusted spacing therebetween. The mounting plates 36 journal a belt drive shaft 40 therefrom including pulleys 42 mounted in adjusted position therealong and the belt drive shaft 40 has a power input pulley 44 mounted on one end thereof aligned with the pulley 26 and about which the upper end of the belt 28 is trained.

Idle pulleys 46 aligned with the pulleys 42 are mounted from the mounting plates 38 and in feed belts 48, including upper reaches 49, are trained about each pair of pulleys 42 and 46, the pulleys 46 being aligned with the adjusted positions of the pulleys 42 by adjustment of the mounting brackets 38 along the mounting bar 34 which is slotted as at 50 to accomplish such adjustment.

In addition, the in feed section of the conveyor 10 includes two sets of positioning rollers 52 and 54 which overlie the belts 48, the first encountered rollers 52 being considerably larger than the following rollers 54 in each set of rollers 52 and 54 and the rollers 52 and 54 being journaled from bearing holders 56 pivotally supported from pivot brackets 58 mounted from uprights 60 supported from the upper portions of the mounting plates 36.

The conveyor belts 48 move continuously at variably adjusted speeds and are driven by the motor 18. Further, the belts 48 receive selected length cut sheets of paper or other flexible material in succeeding sets of sheets from a rolled web of the material fed to and cut into the selected same or different lengths by a bowe cutter (or other means) 62 disposed at the inlet end of the conveyor 10.

The motor 18 has its speed of operation variably controlled by a variable speed control 64, see FIG. 2, and the tension of the belt 28 may be adjusted by vertically adjusting the motor 18 on the mounting plate 20. Further, the positioning of the pulleys 46 toward and away from the pulleys 42 is accomplished by the slotted ends of the mounting plates 38 from which the pulleys 46 are journalled. Thus, the tensioning of the belts 48 also may be precisely controlled.

In addition to the variable speed control 64, the frame 12 also supports a microprocessor 66 therefrom and the microprocessor is operatively associated with the bowe cutter 62 in a well known manner whereby the web of material fed to the bowe cutter may be cut in sets of multiple sheets of the same length, in sets of sheets of different length and wherein the number of sheets cut in each set are counted.

With attention now invited again more specifically to FIGS. 2 and 4, a servo motor 68 with encoder and gear box is vertically adjustably mounted from a mounting plate 70 supported from the frame 12 through the utilization of fasteners (not shown) received through vertical mounting slots 72 formed in the mounting plate 72. The motor 68 includes a rotary output shaft 74 upon which a toothed pulley 76 is mounted and the lower end of a toothed belt 78 is trained about the pulley 76.

A drive shaft 80 is journalled from the side plates 32 and 34 through the utilization of bearings 82 and the shaft 80 includes a toothed power input pulley 84 thereon about which the upper end of the belt 78 is trained.

The shaft 80 supports a pair of toothed drive pulleys 88 thereon which are adjustable in position along the shaft 80 and the outlet end portion of the side plates 30 and 32 journal an idle shaft 90 thereon upon which idle pulleys 92 are adjustably mounted in alignment with the pulleys 88. Each pair of pulleys 88 and 90 has a toothed belt 94, including an upper reach 95, trained thereabout and each belt 94 has mounting blocks 96 spaced therealong with combined stop and pusher links or abutment means 98 mounted from selected blocks 96 through the utilization of stands 100.

Also, three T-slotted braces 102 are spaced longitudinally of the conveyor 10 extend and are secured between the side plates 30 and 32. A T-slotted front side track and anvil holder 104 is supported from the braces 102 through the utilization of stands 106 adjustably slidably mounted from the braces 102 through the utilization of T-nuts 108 and a T-slotted rear side track and anvil holder 110 is similarly supported from the braces 102. Thus, the side tracks and anvil holders 104 and 110 may be adjusted transversely of the conveyor 10.

A pair of track mount blocks 112 are adjustably mounted in a similar manner from each of the braces 102 and each set of track mount blocks 112 supports a top plate 116, a bottom plate track 118 and a track side plate 120 therefrom.

In addition to the front and rear side track and anvil holders 104 and 110, a center anvil holder 124 (also T-slotted) is supported from the braces 102 through the utilization of stands 126 also supported from the braces 102 through the utilization of T-nuts and a plurality of pairs of elongated material supports 128 are supported from stands 130 corresponding to the stands 106 through the utilization of bolt clamps 132, the track mount blocks 112 being mounted from the corresponding stands through the utilization of similar bolt clamps 134.

In operation a web of paper (not shown) is fed to the bowe cutter 62 from a large roll. Printed material to be collated in sets of sheets of paper may appear on the web in even length areas thereof or in unequal length areas thereof, as required by the amount of printing material appearing on each area of the web to ultimately comprise a separate paper sheet. The microprocessor 66 is programmed to actuate the bowe cutter 62 at the proper time as the web of paper from the roll is moved through the bowe cutter 62. The frame 12 includes a power supply and amplifier unit 136 for supplying current to the microprocessor and the motors 18 and 68 through the microprocessor 66, the speed of operation of the motor 64 being variable as desired.

As the individual sheets of paper, the width of which being predetermined and the spacing between the track side plates 120 being adjusted to conform to the width of the sheets of paper to be handled thereby, are discharged from the bowe cutter 62 they are advanced along the inlet end of the conveyor 10 above and in driving contact with the continuously moving belts 48 and below the rollers 52 and 54, the rollers 52 being of large diameters in order to prevent curling up of the leading edges of the paper sheets moving along the belts 48.

The discharge ends of the belts 48 overlap the inlet ends of the belts 94 and flexible hold-down straps (not shown) overlie and lightly hold down the cut sheets of paper being discharged from the discharge ends of the belts 48.

Upon the assumption that a first set of individual cut sheets being discharged from the belts 48 are now to be collated into a predetermined set of sheets, the belts 94 are stationary and the successive individual sheets of paper being discharged from the belts 48 to form a single set of collated sheets whose leading edge abut against and are stopped by one set of transversely aligned pushers combined stop and pusher links 98 supported from the belts 94. As soon as the proper number of sheets in the desired collated set of sheets have been cut and allowed sufficient time to travel the length of the belts 48 and beneath the rollers 52 and 54 and to abut against the pre-positioned pusher links 98, the then collated set of sheets (either of the same length or of different lengths) are advanced along the conveyor 10 between the top and bottom plates 116 and 118 and over the material supports 128 a predetermined distance by the following pusher links 98. After the collated set of sheets has been advanced along the conveyor 10 a predetermined distance to a predetermined position, the operation of the drive motor 68 is terminated and the next set of cut sheets moves along the belts 48 to have their leading edges abut against and be stopped by another pusher set of combined stop and link 98. The position or positions at which each set of collated sheets is stopped along the conveyor 10 corresponds with positions along the side plates 30 and 32 and the holders 104, 110 and 124 at which points additional equipment may be attached above the conveyor surface for performing additional operations on the collated material such as stapling, gluing and token tipping. The microprocessor 66 provides electronically controlled interfaces for the control of additional operations.

In addition, the microprocessor 66, in conjunction with motor 68, controls each distance of movement of the belts 94, the rate of acceleration thereof, the speed of their movement and the rate of deceleration thereof. Further, the speed of rotation of the in feed belts 48 may be controlled independently of the speed of operation of the belts 9 in conjunction with the speed of operation of the bowe cutter.

It also is pointed out that the spacing between the pusher links 98 may be adjusted and further that the pusher links are spring loaded in an upright position. In this manner, should a material jam take place, the pushers in contact with this material, under increased loading, snap below the conveyor track surface and in doing so protect the conveyor drive components from damage. Also, the pusher links 98 are used to assist the collation process by aligning materials in the collation area. As herein before set forth, the spacing between the belts 94 also may be adjusted and, therefore, the width between transversely aligned pusher links 98 may be varied to accommodate narrow and wide materials.

By the foregoing description it will noted that sets of collated sheets of the same and different lengths may be readily formed at a relatively high speed from a single web roll of printed material. Further, the conveyor can be adjusted according to the width of the web from which the sheets to be collated are cut and also adjusted according to the maximum length of each set of collated sheets. Furthermore, after each set of sheets is collated and moves progressively toward the discharge end of the conveyor 10 additional operations may be carried out thereon by additional equipment mounted upon the anvils 104, 110 and 124 and thus from the side plates 30 and 32.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within he scope of the invention.

What is claimed as new is as follows:

1. A multi-length sheet material conveyor and collator including elongated, end aligned first and second conveyor means each including independently driveable conveyor belt means, the belt means of each conveyor means, at the adjacent ends of said conveyor means, being lengthwise lapped over the belt means of the other conveyor means in laterally spaced relation thereto, said first conveyor means including hold down means extending therealong for lightly holding down cut sheet material successively moving therealong, the belt means of said second conveyor means being intermittently actuatable and including cut sheet stop means against which successive cut sheets discharged for first conveyor means may abut for collation prior to intermittent actuation of said second conveyor means, said first conveyor means being operative to discharge successive different length sheets therefrom onto said second conveyor means, said second conveyor means including upper and lower pairs of laterally spaced apart top and bottom plates between which said cut sheets and the collated sheets of cut sheets are conveyed along said second conveyor means.

2. A multi-length sheet material conveyor and collator including first conveyor means having intake and discharge ends, second conveyor means having inlet and outlet ends, said first conveyor means being adapted to convey cut sheets of equal or different lengths therealong, said discharge end being positioned to discharge conveyed sheets therefrom onto said inlet end, said second conveyor means including abutment means for abutment by cut sheets from said first conveyor means whereby to receive a predetermined number of cut sheets from said first conveyor means and collate said predetermined number sheets into a set of cut sheets with the leading edges of said cut sheets transferred from said first conveyor means to said second conveyor means being registered, means to convey successive sets of collated sheets therealong, said second conveyor means including support structure extending therealong from which additional equipment may be supported in space position along said second conveyor means for performing a single or multiple additional operations on the sets of collated sheets conveyed along said second conveyor means, said second conveyor means including upper and lower pairs of laterally spaced apart top and bottom plates between which said cut sheets and the collated sets of cut sheets are conveyed along said second conveyor means.

3. A multi-length sheet material conveyor and collator including first conveyor means having intake and discharge ends, second conveyor means having inlet and outlet ends, said first conveyor means being adapted to convey cut sheets of equal or different lengths therealong, said discharge end being positioned to discharge conveyed sheets therefrom onto said inlet end, said second conveyor means including abutment means for abutment by cut sheets from said first conveyor means whereby to receive a predetermined number of cut sheets from said first conveyor means and collate said predetermined number sheets into a set of cut sheets, means operative to intermittently drive said second conveyor means to convey successive sets of collated sheets therealong, said second conveyor means including support structure extending therealong from which additional equipment may be supported in space position along said second conveyor means for performing a single or multiple additional operations on the sets of collated sheets conveyed along said second conveyor means, each of said first and second conveyor means being adjustable in width, said second conveyor means including upper and lower pairs of laterally spaced apart top and bottom plates between which said cut sheets and the collated sets of cut sheets are conveyed along said second conveyor means.

4. The conveyor and collator of claim 3 wherein each of said first and second conveyor means includes a pair of laterally spaced apart and simultaneously driven conveyor belts.

5. A multi-length sheet material conveyor and collator including an elongated conveyor frame having sheet receiving and discharging ends, first conveyor means disposed at said sheet receiving end of said frame for receiving successive cut sheets from a cutter and conveying said cut sheets partway along said conveyor frame toward the sheet discharge end thereof, second intermittently advanceable conveyor means supported from said frame and extending therealong including an inlet end corresponding to said conveyor frame sheet receiving end and an outlet end corresponding to said sheet discharge end, said second conveyor means including combined cut sheet stop means and cut sheet pusher means supported therefrom at points spaced predetermined distances therealong, said first conveyor means being operable to successively convey a predetermined number of cut sheets therefrom into position upon said second conveyor means inlet end between an adjacent pair of sheet stop and sheet pusher means spaced along said inlet end and into collated position with the leading edges of said predetermined number of sheets abutted and aligned against one of said cut sheet stop means, and means operative to intermittently advance said second conveyor means along said conveyor frame a predetermined distance responsive to said predetermined number of cut sheets being conveyed by said first conveyor means into said collated position, said second conveyor means including upper and lower pairs of laterally spaced apart top and bottom plates between which said cut sheets and the collated sets of cut sheets are conveyed along said second conveyor means.

6. The conveyor and collator of claim 5 wherein said second conveyor means belts carry said cut sheet stop means and cut sheet pusher means with said belts disposed beneath the level of said top and bottom plates and said cut sheet stop means and cut sheet pusher means project upwardly from said second conveyor means belts from the latter to a level above said top plates.

7. A multi-length sheet material conveyor and collator including an elongated conveyor frame having sheet receiving and discharging ends, first conveyor means disposed at said sheet receiving end of said frame for receiving successive cut sheets from a cutter and conveying said cut sheets partway along said conveyor frame toward the sheet discharge end thereof, second intermittently advanceable conveyor means supported from said frame and extending therealong including an inlet end corresponding to said conveyor frame sheet receiving end and an outlet end corresponding to said sheet discharge end, said second conveyor means including combined but sheet stop means and cut sheet pusher means supported therefrom at points spaced predetermined distances therealong, said first conveyor means being operable to successively convey a predetermined number of cut sheets therefrom into position upon said second conveyor means inlet end between an adjacent pair of sheet stop and sheet pusher means spaced along said inlet end and into collated position on said second conveyor means, and means operative to intermittently advance said second conveyor means along said conveyor frame a predetermined distance responsive to said predetermined number of cut sheets being conveyed by said first conveyor means into said collated position, each of said first and second conveyors being adjustable in width, said second conveyor means including upper and lower pairs of laterally spaced apart top and bottom plates which said cut sheets and collated sheets of cut sheets are conveyed along said second conveyor means.

8. The conveyor and collator of claim 7 wherein each of said first and second conveyor means includes a pair of laterally spaced apart and simultaneously driven conveyor belts.

9. The conveyor and collator of claim 7 wherein said second conveyor means includes supports extending longitudinally therealong from which additional equipment for performing additional operations on the sets of collated sheets intermittently advanced along said second conveyor means.

10. A multi-length sheet material conveyor and collator including first conveyor means having intake and discharge ends, second conveyor means having inlet and outlet ends, said first conveyor means being adapted to convey cut sheets of equal or different lengths therealong, said discharge end being positioned to discharge conveyed sheets therefrom onto said inlet end, said second conveyor means including abutment means for abutment by cut sheets from said first conveyor means whereby to receive a predetermined number of cut sheets from said first conveyor means and collate said predetermined number sheets into a set of cut sheets with the leading edges of said cut sheets transferred from said first conveyor means to said second conveyor means being registered, means operative to intermittently drive said second conveyor means to convey successive sets of collated sheets therealong, said second conveyor means including support structure extending therealong from which additional equipment may be supported in spaced position along said second conveyor means for performing a single or multiple additional operations on the sets of collated sheets conveyed along said second conveyor means, said first conveyor means including a plurality of conveyor belts having cut sheet supporting upper reaches extending longitudinally and spaced transversely of said conveyor frame as well as sets of tandem arranged cut sheet hold down rollers spaced transversely of said conveyor frame opposing said upper reaches at points spaced therealong, said second conveyor means also including a plurality of conveyor belts having cut sheet supporting upper reaches extending longitudinally and spaced transversely of said conveyor frame, the upper reaches of said second conveyor means being spaced slightly below the upper reaches of the belts of said first conveyor means and spaced intermediate the first conveyor means belt reaches with the discharging ends of the upper reaches of the first conveyor means end lapped over the inlet ends of the upper reaches of the second conveyor means, said abutment means being carried by said belts of said second conveyor means.

11. The conveyor and collator of claim 10 wherein said second conveyor means includes means operative to adjust the distance along said conveyor frame said second conveyor means, and thus each collated set of cut sheets, is intermittently advanced.

12. A multi-length sheet material conveyor and collator including an elongated conveyor frame having sheet receiving and discharging ends, first conveyor means disposed at said sheet receiving end of said frame for receiving successive cut sheets from a cutter and conveying said cut sheets partway along said conveyor frame toward the sheet discharge end thereof, second intermittently advanceable conveyor means supported from said frame and extending therealong including an inlet end corresponding to said conveyor frame sheet receiving end and an outlet end corresponding to said sheet discharge end, said second conveyor means including combined cut sheet stop means and cut sheet pusher means supported therefrom at points spaced predetermined distances therealong, said first conveyor means being operable to successively convey a predetermined number of cut sheets therefrom into position upon said second conveyor means inlet end between an adjacent pair of sheet stop and sheet pusher means spaced along said inlet end and into collated position on said second conveyor means, and means operative to intermittently advance said second conveyor means along said conveyor frame a predetermined distance responsive to said predetermined number of cut sheets being conveyed by said first conveyor means into said collated position, said first conveyor means including a plurality of conveyor belts having cut sheet supporting upper reaches extending longitudinally and spaced transversely of said conveyor frame as well as sets of tandem arranged cut sheet hold down rollers spaced transversely of said conveyor frame opposing said upper reaches at points spaced therealong, said second conveyor means also including a plurality of conveyor belts having cut sheet supporting upper reaches extending longitudinally and spaced transversely of said conveyor frame, the upper reaches of the belts of said first conveyor means and spaced intermediate the first conveyor means belt reaches with the discharging ends of the upper reaches of the first conveyor means end lapped over the inlet ends of the upper reaches of the second conveyor means, said combined cut sheet stop means and cut sheet pusher means being carried by corresponding belts of said second conveyor means for abutting of said cut sheets thereagainst.

13. The conveyor and collator of claim 12 wherein said second conveyor includes means operative to adjust the distance along said conveyor frame said second conveyor means, and thus each collated set of cut sheets, is intermittently advanced.

* * * * *